United States Patent [19]

Sugita et al.

[11] 4,451,558

[45] May 29, 1984

[54] SILVER HALIDE COLOR PHOTOGRAPHIC LIGHT-SENSITIVE MATERIAL

[75] Inventors: Hiroshi Sugita; Satoshi Kawakatsu; Yutaka Kaneko, all of Hino, Japan

[73] Assignee: Konishiroku Photo Industry Co., Ltd., Tokyo, Japan

[21] Appl. No.: 500,270

[22] Filed: Jun. 2, 1983

[30] Foreign Application Priority Data

Jun. 10, 1982 [JP] Japan ..... 57-100087

[51] Int. Cl.[3] ..... G03C 7/26

[52] U.S. Cl. ..... 430/546; 430/552; 430/553

[58] Field of Search ..... 430/546, 552, 553

[56] References Cited

U.S. PATENT DOCUMENTS

| | | | |
|---|---|---|---|
| 3,446,622 | 5/1969 | Magagnoli et al. | 430/376 |
| 3,880,661 | 4/1975 | Lau et al. | 430/553 |
| 4,228,233 | 10/1980 | Yagihara et al. | 430/553 |
| 4,250,251 | 2/1981 | Osborn et al. | 430/553 |
| 4,333,999 | 6/1982 | Lau | 430/552 |

*Primary Examiner*—J. Travis Brown

*Attorney, Agent, or Firm*—Jordan B. Bierman; Linda Bierman

[57] ABSTRACT

A silver halide color photographic light-sensitive material containing a phenol cyan coupler having an ureido group in the 2-position dispersed in a phthalic ester.

11 Claims, No Drawings

SILVER HALIDE COLOR PHOTOGRAPHIC LIGHT-SENSITIVE MATERIAL

BACKGROUND OF THE INVENTION

The invention relates to a silver halide color photographic light-sensitive material and, more particularly, to a silver halide color photographic light-sensitive material which is excellent in the absorption spectra of cyan dyes produced by a coupling reaction with oxidants of a color developing agent.

Still more detailedly, the invention relates to a silver halide color photographic light-sensitive material in which ortho-positioned ureido type hydrophobic phenol couplers are dispersed by making use of a specific phthalic acid ester and thus obtained dispersed matter is contained stably in silver halide emulsions, and in which the absorption spectra of cyan dyes produced by the color development of the couplers are of long wave length and less in the secondary absorption of green spectrum, that is, the absorption spectra of the cyan dyes are preferable for color reproduction.

Heretofore, naphthol couplers have been used for cyan couplers of highly light-sensitive color negative photographic materials. These cyan couplers have been put into practice because they are characterized in that the absorption spectra of cyan dyes produced by a reaction with the oxidants of a color developing agent are of long wave length and less in the secondary absorption of green spectrum, that is, the absorption spectra of the cyan dyes are preferable for color reproduction.

However, in the recent years, the general tendency is being directed to the resource-saving from the viewpoint of silver shortage and the like, and the current types of color negative photographic light-sensitive materials are being shifted to those in an extremely small format of the picture size from, for example, 135 mm size to 110 size and further most recently to a disk film size of 8×10 mm that has most recently been put on the market. These light-sensitive materials of such a small format must, however, record a lot of information onto the much smaller area thereof than the areas of conventional types of light-sensitive materials, and eventually the print magnification becomes larger. It is therefore indispensable to apply technics for improving image quality such as graininess and sharpness.

In disk films, it has been reported that the technic for improving image sharpness was achieved by making use of DIR couplers which can display an excellent edge-effect and by thinning the coated layer on the film, and it may be indicated that the graininess thereof has been achieved by increasing the amount of silver coated. None the less, there is a serious disadvantage in these achievements that conventional types of naphthol cyan dyes cause a reduction discoloration by a large amount of ferrous ions produced in the course of a bleach or a bleach-fix process for developed silver in a processing liquid, that has made such naphthol cyan couplers difficult to use.

As mentioned above, it is necessary to increase the amount of silver to be coated if required for improving the graininess of small-format light-sensitive materials. In such a light-sensitive material, it must note that it is itself necessary to have a coupler not causing any reduction discoloration by ferrous ions of cyan dye but having a spectral absorption characteristics equivalent to those of conventional types of naphthol cyan dyes.

As for the couplers not causing any reduction discoloration of cyan dyes in course of a bleach or a bleach-fix process, there are known couplers each substituted by an acylamino radical at the ortho and the meta positions of phenol as disclosed in U.S. Pat. No. 2,895,826, Japanese Patent Publication Open to the Public Inspection (hereinafter referred to as Japanese Patent O.P.I. Publication) Nos. 112038/1975, 109630/1978 and 163537/1980, and the like. In the absorption spectra of the color developable dyes of everyone of these couplers, there are the respective maximum absorption in the wave-length range shorter than the red spectral range and there are many absorption in the green spectral range, and that has not therefore been preferable from the viewpoint of color reproduction. Phenol couplers each having an ureido radical in the ortho position thereof are described in British Pat. No. 1,011,940, and U.S. Pat. Nos. 3,446,622, 3,996,253, 3,758,308 and 3,880,661. In these couplers, similar to the aforementioned couplers, there are the absorption in the wavelength range shorter than the red spectral range of the absorption spectra of the color developable dyes and the absorption are broad. They are consequently not preferable for color reproduction, and besides there are some couplers which cause color fading in a bleach process, that has been a problem.

On the other hand, phenol couplers each having an ureido radical in the ortho position thereof as described in Japanese Patent O.P.I. Publication No. 65134/1981 will not cause any color fading of the cyan dyes in a bleach process and the respective absorption maximum of the phenol couplers are in a relatively longer wavelength portion of the red spectral range of the absorption spectre thereof, and the green spectral absorption is also less, so that they can display the absorption characteristics closer to those of the naphthol couplers. However, the absorption maximum of the wavelength and the green spectral range (i.e.; sharp-cut of the short wave side) are still not fully satisfied.

In these couplers, there have been few changes in absorption spectra of color developing dyes even if there have used therein with a variety of solvents such as phthalic acid esters, phosphoric esters and the like which have ordinary been used as high-boiling solvents for an oil-soluble additive for photographic use such as antioxidants for couplers, and therefore, absorption spectra have hardly been improved by utilizing the changes of the high boiling solvents used.

SUMMARY OF THE INVENTION

Based on the technical background as mentioned above, the inventors have devoted themselves to study the usage of couplers each not being caused therein any color fading in a bleach process and having absorption spectral characteristics of the color developing dyes thereof equivalent to those of naphthol dyes and the usage of the high boiling solvents to be used with the couplers, and resultantly, they have found out the amazing effect that the objects of the invention can be achieved in the process that couplers each having an ureido radical in the ortho position given in Formula [I] are dispersed by making use of a specific high boiling solvent of phthalic acid esters having Formula [II] and the dispersed matter is contained in a silver halide emulsion layer.

OBJECTS OF THE INVENTION

It is an object of the invention to provide a silver halide color light-sensitive material in which the absorption maximum is in the long wave-length portion of the red spectral range and by which a cyan dye image having less absorption in green spectral range can be obtained.

Another object of the invention is to provide a silver halide color light-sensitive material in which the cyan dyes thereof are not faded by ferrous ions in the course of a bleaching process.

It is a further object of the invention to provide a silver halide color light-sensitive material in which the graininess thereof is improved.

Abovementioned object of the invention can be achieved with a silver halide color photographic light-sensitive material comprising a support provided thereon a hydrophilic colloidal layer containing at least one kind of phenol cyan coupler having the Formula [I] in which an ureido radical is 2-position and being dispersed by making use of a phthalic ester having the Formula [II]:

Formula [I]

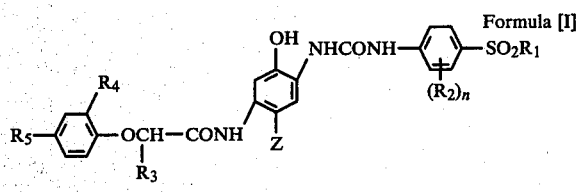

wherein $R_1$ represents a straight or branched alkyl, cycloalkyl radical, $R_2$ represents a hydrogen atom, a halogen atom or a monovalent organic radical, $R_3$ represents a straight or branched alkyl radical, $R_4$ and $R_5$ each represents a branched alkyl radical, Z represents a hydrogen atom or a radical capable of eliminating in a coupling reaction with an oxidation product of a color developing agent, n represents an integer of 0 to 3, preferably 0 or 1.

Formula [II]

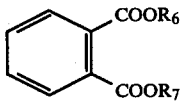

Wherein $R_6$ and $R_7$ each represent an alkyl, alkenyl, aryl or cycloalkyl radical.

In the Formula [I] as for the halogen represented by $R_2$, chlorine and bromine are preferable. As for the monovalent organic radicals, for example, the following are given; an alkyl radical and inter alia preferably a straight or branched alkyl radical having 1 to 4 carbon atoms and more preferably methyl or tert-butyl, an aryl radical and inter alia preferably a substituted or unsubstituted phenyl radical, a heterocyclic radical and inter alia preferably a nitrogen-containing heterocyclic radical and more preferably pyrrolidine or piperidine, a hydroxy radical, an alkoxy radical and inter alia preferably a susbstituted or unsubstituted alkoxy radical having 1 to 8 carbon atoms and more preferably a methoxy, tert-butyloxy, or methoxycarbonyl methoxy radical or the like, an aryloxy radical and inter alia preferably a substituted or unsubstituted phenoxy radical, an acyloxy radical and inter alia preferably a substituted or unsubstituted alkylcarbonyloxy radical, arylcarbonyloxy radical or the like, a mercapto radical, an alkylthio radical or the like, a mercapto radical, an alkylthio radical and inter alia preferably a substituted or unsubstituted alkyl radical having 1 to 8 carbon atoms and more preferably a methylthio radical, a nitro radical, a cyano radical, an acyl radical and inter alia preferably an alkylcarbonyl radical having 1 to 8 carbon atoms and more preferably an acetyl radical or pivaloyl radical, an amino radical, an alkylamino radical and inter alia preferably a straight or branched alkylamino radical having 1 to 4 carbon atoms and more preferably a methylamino radical, ethylamino radical or tert-butylamino radical, or a dialkylamino radical and inter alia preferably dimethylamino radical or diethylamino radical.

As the monovalent organic radical, an acyloxy radical such as an acetoxy or benzoyloxy radical, a nitro radical and a cyano radical are more preferable.

$R_1$ represents preferably an alkyl radical having 1 to 20 carbon atoms, such as a methyl, ethyl, n-propyl, Sec-propyl, n-butyl, tert-octyl, n-dodecyl, or benzyl radical and the like; a cycloalkyl radical such as a cyclohexane radical or the like.

Rhd 4 and $R_5$ each preferably represent a branched alkyl radical having 3 to 20 carbon atoms, such as a tert-butyl, tert-pentyl, or tert-octyl radical, and $R_4$ and $R_5$ may be the same with or the different from each other and preferably be the same.

In the Formula [I], as for the radicals represented by Z capable of eliminating in the course of a coupling reaction with oxidation products of a color developing agent, the following radicals may be given as a halogen atom such as chlorine, bromine, fluorine, an aryloxy, carbamoyloxy, carbamoylmethoxy, acyloxy, sulfonamide or succinimide radical wherein oxygen atom or nitrogen atom is directly coupled in the coupling position, and more concretely the examples thereof are described respectively in U.S. Pat. No. 3,471,563, Japanese Patent O.P.I. Publication Nos. 37425/1972, 10135/1975, 117422/1975, 130441/1975, 108841/1976, 120334/1975, 18315/1977, 52423/1978 and 105226/1978, and Japanese Patent Examined Publication No. 36894/1973.

Couplers of the invention can be synthesized in the processes described respectively in Japanese Patent Application Nos. 90334/1981, 90335/1981, 90336/1981 and the like.

Cyan couplers of the invention having Formula [I] are exemplified as follows and it is however to be understood that they shall not be limited to the cyan couplers hereby exemplified:

(1)

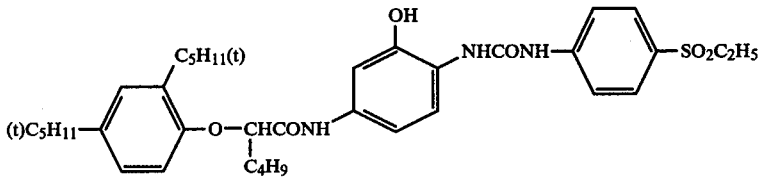

-continued (2)

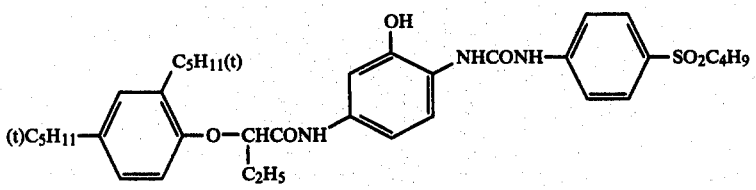

(3)

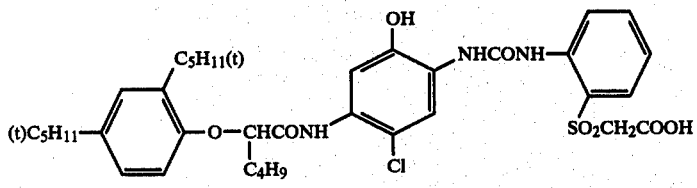

(4)

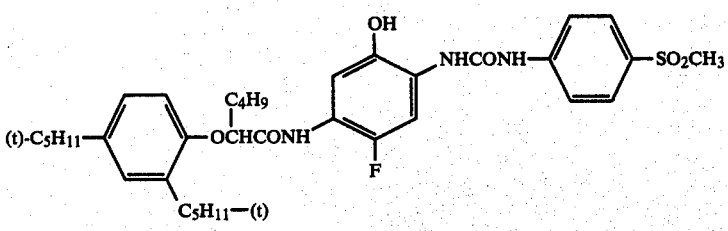

(5)

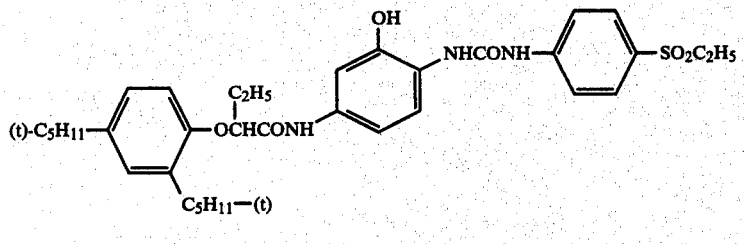

(6)

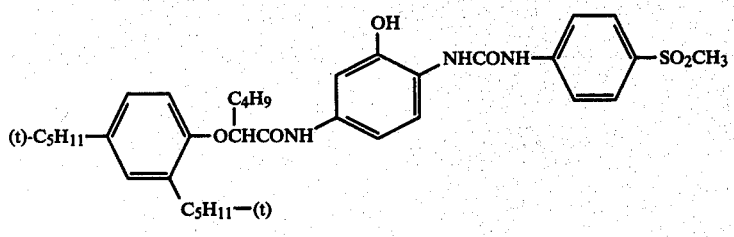

(7)

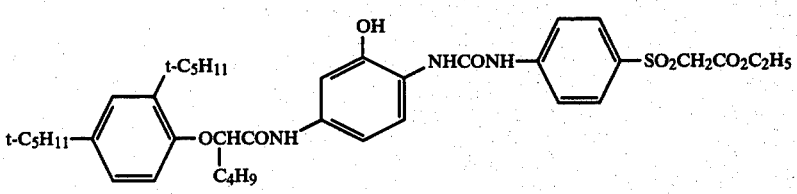

(8)

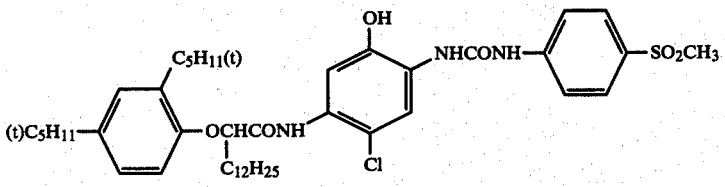

Phenol cyan couplers relating to the invention and having the Formula [I] may be prepared in such a synthesizing process as described in Japanese Patent O.P.I. Publication No. 204545/1982.

Next, phthalic acid ester high boiling solvents to be used in the invention are formularized in the aforegiven Formula [II], and the particularly preferably phthalic acid esters for the invention are those in which $R_6$ and $R_7$ each represent, in the Formula [II], a straight or branched alkyl radical having 4 to 12 carbon atoms, such as an n-butyl, Sec-butyl, n-hexyl, Sec-octyl, or n-dodecyl radical and the like, or, a substituted or unsubstituted aryl radical having 6 to 12 carbon atoms, such as a phenyl, or, tolyl radical and the like. Further preferable ones thereof are those in which both of $R_6$ and $R_7$ are a straight or branched alkyl radical having 4 to 12 carbon atoms.

Phthalic acid ester compounds to be used of the invention may be exemplified below, and it is however understood that they shall not be limited thereto:

P-1
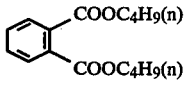

P-2
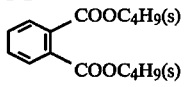

P-3
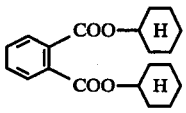

P-4
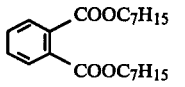

P-5
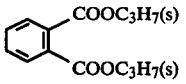

P-6
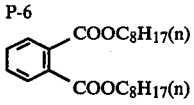

P-7
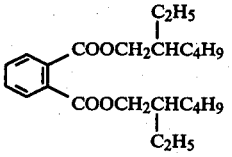

P-8
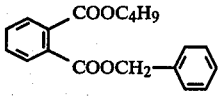

P-9
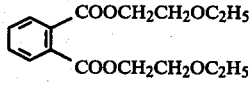

P-10
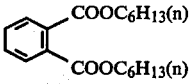

P-11
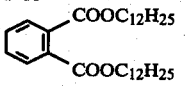

P-12
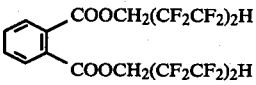

P-13
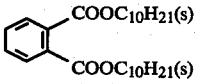

P-14
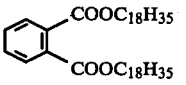

P-15
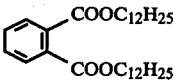

P-16
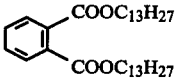

P-17
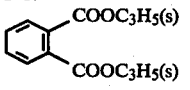

P-18
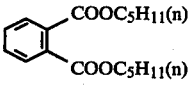

P-19
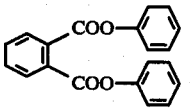

P-20
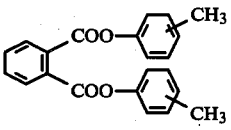

The abovementioned high boiling solvents are available from the market as a merchandise.

The invention displays the amazing effects that the spectral absorption characteristics equivalent to those of naphthol cyan dyes are obtainable and that any discoloration cannot be occurred in a bleaching process, in the manner that a cyan coupler having Formula [I] are dispersed to and contained in a hydrophilic colloidal layer by making use of a high boiling solvent having Formula [II].

It is also allowed to use two or more kinds of these high boiling solvents in combination. And, if occasion demands, these high boiling solvents may be used in combination with the other high boiling solvents or low boiling solvents on condition that the effects of the invention shall not be spoiled.

The amount of the abovementioned high boiling organic solvent used in the invention is 0.05 to 15 parts by weight and more preferably 0.1 to 6.0 parts by weight to one part of the aforesaid cyan couplers.

In the invention, as mentioned above, cyan couplers relating to the invention are dispersed by making use of high boiling solvents relating to the invention and are then contained in a hydrophilic colloidal layer, however, in general, a silver halide color photographic light-sensitive material has a multi-layered constitution and comprises a support bearing thereon a plurality of color dye image forming component unit layers being spectrally sensitized in each of the spectral regions and if necessary bearing thereon, besides the abovementioned unit layers, such a non-light-sensitive auxiliary layer as a protective layer, inter layer including, e.g., a non-sensitized emulsion layer, a filter layer, irradiation layer, an antihalation layer and the like, and such layers constituting a color light-sensitive material ordinarily comprise hydrophilic colloidal layers.

Cyan couplers having Formula [I] which are to be used in the invention may also be applied with the processes and techniques to be applied for an ordinary cyan dye forming coupler.

In the invention, cyan couplers relating to the invention are compounded in a light-sensitive silver halide emulsion layer which is preferably one of the hydrophilic colloidal layers, and the emulsion layer is coated over to the support, and thus, a color photographic light-sensitive material is formed. In a multi-color photographic light-sensitive material, cyan dye forming couplers relating to the invention are contained ordinarily in a red-sensitive silver halide emulsion layer. However, in the invention, cyan couplers relating to the invention may also be contained in a silver halide emulsion layer having the light-sensitivity thereof in a different spectral region from that of the above-mentioned red-sensitive silver halide emulsion layer, and in addition thereto, they may further be contained in the other constitutional layers. In a silver halide color photographic light-sensitive material of the invention, each of the abovementioned constitutional unit layers may comprise a single emulsion layer or a multi-layered emulsion layer which is light-sensitive to a certain region of a spectrum. The layers of the abovementioned light-sensitive material including an image forming unit layer may be arranged in a variety of the orders being well-known in the art. Typical multi-color photographic light-sensitive materials comprise a support bearing thereon a cyan dye image forming unit comprising at least one red-sensitive silver halide emulsion containing at least one cyan dye forming coupler in which at least one of the cyan dye forming couplers is a coupler of the invention, a magenta dye image forming unit comprising at least one green-sensitive silver halide emulsion layer containing at least one magenta dye forming coupler, and a yellow dye image forming unit comprising at least one blue-sensitive silver halide emulsion layer containing at least one yellow dye forming coupler, and the material may have additional layers such as the aforementioned filter layer, an interlayer, a protective layer, and besides, a subbing layer and the like.

A conventional process having hitherto been publicly known may be used for containing the couplers relating to the invention into an emulsion. For example, a silver halide emulsion to be used for the invention may be prepared in such a process that couplers of the invention may be prepared in such a process that couplers of the invention are dissolved independently or in combination in a high boiling solvent relating to the invention or, if required, in a mixed solution of the abovementioned solvent and a low boiling solvent such as butyl acetate, butyl propionate or the like, and the solution obtained is then mixed with an aqueous gelatin solution containing a surface active agent, and next, the mixture is emulsified by means of a high-speed rotary mixer or a colloid mill, and the emulsion obtained is added to silver halide. In the case of adding the couplers relating to the invention into silver halide emulsion, preferably, approximately 0.07 to 0.7 mole of the couplers per mole of silver halide, and more preferably, 0.1 to 0.4 mole are normally added.

As for the silver halide to be used in silver halide emulsions of silver halide color photographic light-sensitive materials of the invention, there are included any arbitrary silver halide to be used in such a normal silver halide emulsion as silver bromide, silver chloride, silver iodobromide, silver chlorobromide, silver chloroiodobromide and the like.

As for the binders for hydrophilic colloidal layers forming the silver halide emulsion layers or the other constitutional layers of the abovementioned light-sensitive materials of the invention, there have so far been used the well-known ones, for example, gelatin and such a gelatin derivative as phenylcarbamylated gelatin, acylated gelatin, phthalated gelatin and the like. These binders are allowed to use if occasion demands as a compatible mixture of not less than two kinds thereof.

It is possible to prepare a silver halide emulsion which is to be used in the invention in a variety of the preparation processes including processes being usually used, for example, such processes as described in Japanese Patent Examined Publication No. 7772/1971, namely, the so-called conversion emulsion preparation process in which a silver salt particle emulsion comprising at least one part of silver salt whose solubility is greater than that of silver bromide is formed and at least one part of these silver salt particles is then converted into silver bromide or silver iodobromide and the like processes, a preparation process for Lippmann emulsion comprising a fine grain silver halide having the average grain size of no larger than 0.1$\mu$, or the like.

Further, silver halide emulsion in the invention may be chemically sensitized by making suitable use independently or in combination of a sulphur sensitizer such as allylthio carbamide, thio urea, cystine, or the like; an active or inactive selenium sensitizer; a reduction sensitizer such as stannous salt, polyamine or the like; a noble metal sensitizer such as a gold sensitizer and, more concretely, potassium aurithiocyanate, potassium chloraurate, 2-aurosulfobenzothiazole methyl chloride or the like; or a water-soluble salt sensitizer such as a salt of ruthenium, rhodium, iridium or the like and more concretely, ammonium chloropalladate potassium chloroplatinate, sodium chloropalladite or the like.

The abovementioned silver halide emulsions may also contain a variety of photographic additives which have publicly been known. For example, there is such a photographic additive as described in "Research Disclosure", Article No. 17643, Dec., 1978.

Silver halide which is to be used in a silver halide color photographic light-sensitive material of the invention is spectrally sensitized by making use of a suitably selected sensitizing dye with the purpose of endowing with the light-sensitivity to a light-sensitive spectral region necessary for a red-sensitive emulsion.

As for the spectrally sensitizing dyes, a variety thereof may be used independently or in combination. As for the spectrally sensitizing dyes which are to be used advantageously in the invention, the examples thereof may be typically given as a cyanine dye, merocyanine dye or conjugated cyanine dye described in U.S. Pat. Nos. 2,269,234, 2,270,378, 2,442,710, 2,454,620, 2,776,280, and the like.

The abovementioned light-sensitive material of the invention may be developed, after it is exposed to light, in a well-known process having popularly been used. For example, it may be color developed in a color developing process having popularly been used.

Color developing liquids which are preferably usable for color-developing the abovementioned photographic light-sensitive material of the invention principally comprise an aromatic primary amine color developing agent of which the concrete examples are typically given as those of p-phenylene diamine such as diethyl-p-phenylene diamine chloride, monomethyl-p-phenylene diamine chloride, dimethyl-p-phenylene diamine chloride, 2-amino-5-diethylamino toluene chloride, 2-amino-5-(N-ethyl-N-dodecylamino)-toluene, 2-amino-5-(N-ethyl-N-$\beta$-methanesulfonamide ethyl)aminotoluene sulfide, 4-(N-ethyl-N-$\beta$-methanesulfonamide ethylamino)aniline, 4-(N-ethyl-N-$\beta$-hydroxyethylamino)aniline, 2-amino-5-(N-ethyl-N-$\beta$-methoxy ethyl)aminotoluene, and the like.

After a development is completed, a series of normal processes of bleaching, fixing or bleach-fix, washing and drying is carried out for removing silver and silver halide.

The invention will be more concretely described by the following examples; however, these examples are not to be constructed to limit the embodiments of the invention.

EXAMPLE 1

Coupler of the invention and control couplers (A), (B), (C) and (D) shown in Table 1 were taken respectively in the amount of 10 mol% to Ag, and each of the couplers taken was added to the respective mixture of such a high boiling solvent as shown in Table 1 in one-half of the amount by weight of the couplers and ethyl acetate in three times the amount by weight of the couplers, and then heat was applied thereto to dissolve completely. Thus obtained solutions each were mixed with 200 ml of aqueous solution of 5% gelatin containing 20 ml of aqueous solution of 5% alkanol B (i.e., alkyl naphthalene sulfonate, mfd. by Du Pont), and an emulsification-dispersion of each mixture was made by means of a colloid mill, and thus each emulsified matter was obtained.

After then, the dispersed solutions were added respectively to 1 kg of red-sensitive silver iodobromide emulsion containing 6 mol% of silver iodide, and thereto 20 ml of solution of 2% 1,2-bis-(vinyl sulfonyl)ethane (of which the proportion was water: methanol=1:1) were added, and the mixtures each thus obtained were coated onto a sublayered transparent polyethylene terephthalate base and were dried up, and thus, Samples (1-1) through (1-10) were prepared. (Silver amounts coated each: 20 mg/dm$^2$)

Control Coupler (A)

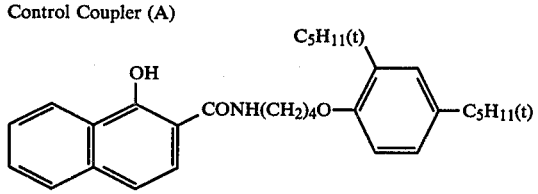

Control Coupler (B): Compound described in U.S. Pat. No. 3,880,661

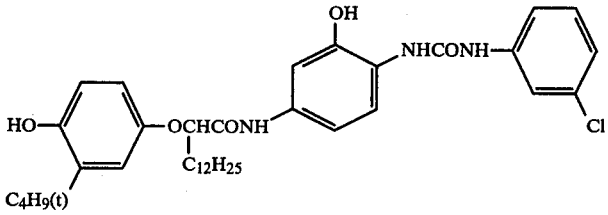

Control Coupler (C): Compound described in Japanese Patent Publication O.P.I. No. 65134/1981

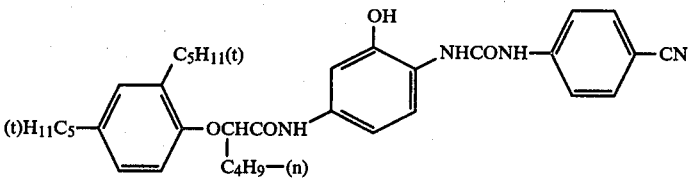

Control Coupler (D):

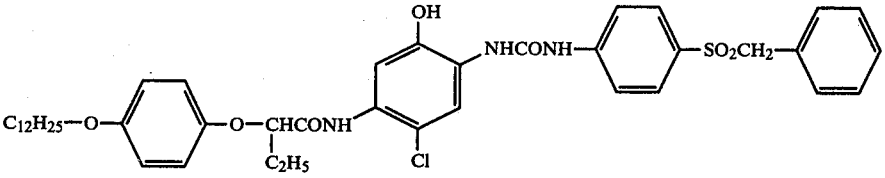

Thus prepared Samples (1-1) through (1-10) were exposed to light in a conventional method and then developed in the following process. The results obtained are shown in Table 1.

| [Developing Process](at 38° C.) | Processing Time |
|---|---|
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |

Composition of each processing liquid used in the abovementioned processes was as follows:

| | |
|---|---|
| [Color developing liquid composition] | |
| 4-amino-3-methyl-N—ethyl-N—(β-hydroxy ethyl)-aniline sulfate | 4.75 g |
| Sodium sulfite, anhydrous | 44.25 g |
| Hydroxyamine ½ sulfate | 2.0 g |
| Potassium carbonate, anhydrous | 37.5 g |
| Sodium bromide | 1.3 g |
| Nitrilotriacetic acid 3 sodium salt (monohydrate) | 2.5 g |
| Potassium hydroxide | 1.0 g |
| Add water to make | 1.0 ltr. |
| Adjust pH value by making use of potassium hydroxide to | pH 10.0 |
| [Bleaching liquid composition] | |
| Ethylenediamine tetraacetic acid iron ammonium salt | 100.0 g |
| Ethylenediamine tetraacetic acid 2 ammonium salt | 10.0 g |
| Ammonium bromide | 150.0 g |
| Glacial acetic acid | 10.0 ml |
| Add water to make | 1.0 ltr. |
| Adjust pH value by making use of aqueous ammonia to | pH 60.0 |
| [Fixing liquid composition] | |
| Ammonium thiosulfate (50% aqueous solution) | 162 ml |
| Sodium sulfite, anhydrous | 12.4 g |
| Add water to make | 1.0 ltr. |
| Adjust pH value by making use of acetic acid to | pH 6.5 |
| [Stabilizing liquid composition] | |
| Formalin (37% aqueous solution) | 5.0 ml |
| Koniducks (mfd. by Konishiroku Photo Ind. Co., Ltd.) | 7.5 ml |
| Add water to make | 1.0 ltr. |

In Table 1, λ-max value indicates the respective absorption maximum values when a cyan color image density is at 1.0, and ΔλS indicates the respective values obtained by the formula below and it expresses that the smaller the value is, the sharper the short-wave side is and the smaller the green-spectral region is absorbed: $\Delta\lambda S(nm) = (\lambda\text{-max. value when } D=1.0) - (\lambda_0 \text{ value when } D=0.2$, on the short-wave side from λ-max. point).

TABLE 1

| Sample No. | Coupler | High boiling solvent | λ-max (nm) | ΔλS (nm) |
|---|---|---|---|---|
| 1 - 1 | Control | Invention P - 1 | 695 | 120 |
| 1 - 2 | Control - B | " | 662 | 123 |
| 1 - 3 | Control - C | " | 692 | 130 |
| 1 - 4 | Control - C | TCP | 688 | 128 |
| 1 - 5 | Control - C | DELA | 684 | 128 |
| 1 - 6 | Control - D | Invention P - 1 | 684 | 132 |
| 1 - 7 | Control - D | TCP | 683 | 133 |
| 1 - 8 | Invention-1 | Invention P - 1 | 696 | 123 |
| 1 - 9 | Invention-1 | TCP | 682 | 125 |
| 1 - 10 | Invention-1 | DELA | 676 | 122 |

From Table 1, it may be understood that the λ-max. of Control Coupler B apparently shows a short wave. Control Coupler C has substantially smaller changes of the λ-max according to the changes of the high boiling solvent, however, the λ-max. value thereof is not better than that of Control Coupler A, and the gradient on the short wave side is also broad. On the other hand, the λ-max. values of the couplers of the invention were of the short-wave when the other high boiling solvents than those of the invention were used, but when the high boiling solvents of the invention were used with the couplers of the invention, the λ-max. value thereof was drastically shifted to the long wave side and the dominant wave length thereof becomes equivalent to that of Control Coupler A, and the gradient on the short wave side was also sharp. It is therefore understood that the invention is preferable for color reproduction.

EXAMPLE 2

By making use of the couplers of the invention and high boiling solvents of the invention each shown in Table 2, Samples (2-1) through (2-4) were respectively prepared by dispersing and coating in the similar manner to that taken in the case of Example 1.

Thus prepared Sample (2-1) through (2-4) were respectively exposed to light and were then developed in the similar manner to that taken in the case of Example 1, and the results were obtained as shown in Table 2. In Table 2, the spectral absorption values were obtained in the similar manner to that taken in Example 1.

TABLE 2

| Sample No. | Coupler | High boiling solvent | Dmax | λmax (nm) | ΔλS (nm) |
|---|---|---|---|---|---|
| 2 - 1 | 1 | P - 10 | 2.20 | 695 | 124 |
| 2 - 2 | 2 | P - 2 | 2.23 | 696 | 124 |
| 2 - 3 | 5 | P - 11 | 2.18 | 693 | 123 |
| 2 - 4 | 8 | P - 13 | 2.50 | 694 | 124 |

It is understood from Table 2 that when the couplers of the invention were respectively dispersed by making use of the high boiling solvents each, the excellent spectral absorption characteristics displayed.

EXAMPLE 3

Samples (3-1) through (3-4) were prepared in the manner that control coupler (A) and the coupler of the invention as shown in Table 3 were taken respectively in the amounts each indicated in Table 3 to the amount of Ag, and each of the couplers taken was added to the respective mixture of dibutyl phthalate (P-1) in one half of the amount by weight of the couplers and ethyl acetate in three times the amount by weight of the couplers, and thus obtained solutions were dispersed, coated and then dried up in the similar manner to that taken in Example 1.

Thus prepared samples were exposed to light and were then processed in the similar manner to that taken in Example 1, and the graininess of each dye image was measured in RMS (Root mean square) method by means of red-light. The measurement results of RMS graininess in the vicinity of color dye density at 0.7 are respectively shown in Table 3.

RMS value is defined as a value 1000 times as many as the standard deviation value of a density variation which may occur when a scanning is made by means of a micro-densitometer whose circular scanning aperture diameter is 25μ.

TABLE 3

| Sample | Coupler | Amount of coupler added* | Amount of Ag. coated (mg/dm$^2$) | γ2 | RMS |
|---|---|---|---|---|---|
| 3 - 1 | Control coupler (A) | 10 | 20 | 0.73 | 50 |
| 3 - 2 | Control coupler (A) | 5 | 30 | 0.70 | 42 |
| 3 - 3 | Invention 6 | 10 | 20 | 0.70 | 48 |
| 3 - 4 | Invention 6 | 5 | 30 | 0.68 | 41 |

It is understood from Table 3 that the graininess of both couplers of the invention and Control Coupler (A) were improved by increasing the amounts of Ag added and by lowering the mole % of the couplers.

Next, coated Samples (3-1) through (3-4) thus obtained as mentioned above were respectively exposed to light in the similar manner to that taken in Example 1, and every Sample was processed for development in the similar manner to that taken in Example 1 except that one group of the Samples were normally processed in the similar manner to that taken in Example 1 and the other group of the samples were processed with the bleaching liquid of which the composition was as follows in place of the bleaching liquid used in Example 1, and then the reduction discoloration of their cyan dyes were inspected.

| [Bleaching liquid composition] | |
|---|---|
| Ethylenediamine tetraacetic acid iron-ammoniun salt | 100 g |
| Ethylenediamine tetraacetic acid 2-ammonium salt | 10 g |
| Ammonium bromide | 150 g |
| Hydrosulfite | 5 g |
| Glacial acetic acid | 10 ml |
| Add water to make | 1 ltr. |
| Adjust pH value by making use of $10NH_2SO_4$ to | pH 5.5 |

In the table, each value is expressed as a percentage of residual color dyes provided the value of the D-max. in processing the samples with a bleaching liquid having an ordinary composition is regarded as 100.

TABLE 4

| Sample | Coupler | Amt. of coupler added* | Amt. of Ag. coated (mg/dm$^2$) | Residual color dye (%) |
|---|---|---|---|---|
| 3 - 1 | Control - A | 10 | 20 | 65 |
| 3 - 2 | Control - A | 5 | 30 | 50 |
| 3 - 3 | Invention-1 | 10 | 20 | 99 |
| 3 - 4 | Invention-1 | 5 | 30 | 100 |

*Amt. of Coupler added: (mole of Coupler/mole of Ag) × 100

From Table 4, it is understood that Control Coupler A apparently causes a reduction discoloration in the cyan dyes, and that the couplers of the invention have no problem at all.

What is claimed is:

1. A silver halide color photographic light-sensitive material comprising a support provided thereon a hydrophilic colloidal layer containing at least one kind of phenol cyan coupler having the Formula [I] in which an ureido radical is 2-position and being dispersed by making use of a phthalic ester having the Formula [II]:

Formula [I]

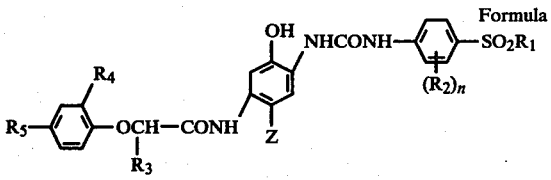

wherein $R_1$ represents a straight or branched alkyl, cycloalkyl radical, $R_2$ represents a hydrogen atom, a halogen atom or a monovalent organic radical, $R_3$ represents a straight or branched alkyl radical, $R_4$ and $R_5$ each represents a branched alkyl radical, Z represents a hydrogen atom or a radical capable of eliminating in a coupling reaction with an oxidation product of a color developing agent, n represents an integer of 0 to 3;

Formula [II]

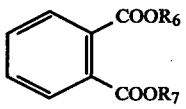

wherein $R_6$ and $R_7$ each represent an alkyl, alkenyl, aryl or cycloalkyl radical.

2. A material according to claim 1, wherein Z represents a hydrogen atom, a halogen atom, an aryloxy, carbamoyloxy, carbamoylmethoxy, acyloxy, sulfonamide or succinimide radical.

3. A material according to claim 1, wherein said monovalent organic radical represented by $R_2$ represents a radical selected from the group consisting of an alkyl, aryl, heterocyclic, hydroxy, alkoxy, aryloxy, acyloxy, mercapto, alkylthio, nitro, cyano, acyl, amino, alkylamino and dialkylamino radical.

4. A material according to claim 2, wherein said alkyl represented by $R_3$ has from 1 to 20 carbon atoms.

5. A material according to claim 1, wherein each of said alkyl represented by $R_4$ and $R_5$ has from 3 to 20 carbon atoms.

6. A material according to claim 1, wherein $R_2$ represents a hydrogen atom, a halogen atom, an acyloxy, nitro, cyano, acyl radical.

7. A material according to claim 1, wherein n represent an integer of 1.

8. A material according to claim 1, wherein $R_1$ represents an alkyl radical having from 1 to 6 carbon atoms.

9. A material according to claim 1, wherein both of $R_4$ and $R_5$ represent a branched alkyl radical.

10. A material according to claim 1, wherein Z represents a hydrogen atom.

11. A material according to claim 1, wherein $R_6$ and $R_7$ represent alkyl radical having from 4 to 12 carbon atoms.

* * * * *